US006755591B1

(12) United States Patent
Rees

(10) Patent No.: US 6,755,591 B1
(45) Date of Patent: Jun. 29, 2004

(54) LIQUID FLOW CONTROLLER DEVICE

(76) Inventor: Douglas Rees, Apt. 3, St Hilda's Wharf 160 Wapping High Street, London E1W 3PG (GB)

( * ) Notice: Subject to any disclaimer, the term of this patent is extended or adjusted under 35 U.S.C. 154(b) by 0 days.

(21) Appl. No.: 10/048,434

(22) PCT Filed: Jul. 30, 1999

(86) PCT No.: PCT/GB99/02234

§ 371 (c)(1),
(2), (4) Date: Sep. 4, 2002

(87) PCT Pub. No.: WO01/09438

PCT Pub. Date: Feb. 8, 2001

(51) Int. Cl.[7] ..... E02B 8/06
(52) U.S. Cl. ..... 405/108; 405/107; 405/87
(58) Field of Search ..... 405/108, 107, 405/77, 78, 80, 81, 87, 88, 89, 92, 94, 96, 99, 100, 101

(56) References Cited

U.S. PATENT DOCUMENTS 843,003 A * 2/1907 Davis ..... 405/95
1,050,930 A * 1/1913 Edge et al. ..... 405/99
3,913,334 A * 10/1975 Turner et al. ..... 405/87
4,394,098 A * 7/1983 Wirschal et al. ..... 405/77
6,485,231 B2 * 11/2002 Montgomery et al. ..... 405/92

* cited by examiner

*Primary Examiner*—Frederick L. Lagman
(74) *Attorney, Agent, or Firm*—Law Office of Royal W. Craig

(57) ABSTRACT

The device is composed of two, horizontally aligned component parts, namely, fixed spinway subtending an angle of 60° and a pivotal wedged-shaped module residing at a specific and constant distance parallel to the spillway face. The wedge-module is designed so that it rotates around a defined arc radius so maintaining both a constant distance between interfaces of the wedged-module and spillway and a constant angle of attack. This device has been demonstrated to accelerate the rate of fluid flow under either low or high head pressures by way of generating a negative pressure (venturi) effect in the device. The nature of the wedge-module is to present a "throat" configuration at the slit opening thereby tending to suck fluid into the device under such negative (venturi) pressures, while maintaining a laminar flow pattern ahead of the wedge-module/spillway arrangement.

6 Claims, 8 Drawing Sheets

Figure 5A

Notch 2 - nominal opening 10mm

| DATE | ANGLE OF ATTACK deg ° | FLOW Q ($m^3/s$) | TOTAL HEIGHT (mm) | HEIGHT VAR (mm) | TIME sec | TEMP °C | BAROMETRIC PRESSURE $N/m^2$ | FLOW READING $M^3$ |
|---|---|---|---|---|---|---|---|---|
| 28-29/4 | | | | | | | | |
| 28 | 0 | 0.0011917 | 271 | 36 | 60 | 18.2 | | 0.0715 |
| 28 | 1 | 0.0013263 | 271 | 36 | 75.4 | 18.2 | | 0.1 |
| 28 | 2 | 0.0013755 | 271 | 36 | 72.7 | 18.2 | | 0.1 |
| 28 | 3 | 0.0014472 | 271 | 36 | 69.1 | 18.2 | | 0.1 |
| 28 | 4 | 0.0014472 | 271 | 36 | 69.1 | 18.2 | | 0.1 |
| 29 | 5 | 0.0014472 | 271 | 36 | 69.1 | 18.2 | | 0.1 |
| 13 | 6 | 0.0007993 | 271 | 36 | 125.1 | 17.1 | | 0.1 |
| 12 | 7.5 | 0.0008489 | 271 | 36 | 117.8 | 17.5 | | 0.1 |
| 21/5/98 | 10 | 0.0008396 | 271 | 36 | 119.1 | 17.4 | | 0.1 |
| 25/5/98 | 12.5 | 0.0008823 | 271 | 36 | 113.3 | 16 | | 0.1 |
| | 15 | 0.0008941 | 271 | 36 | 111.9 | 16.15 | | 0.1 |

Figure 5B

Notch 3 - nominal opening 15 mm

| DATE | ANGLE OF ATTACK deg ° | FLOW Q ($m^3/s$) | TOTAL HEIGHT (mm) | HEIGHT VAR (mm) | TIME sec | TEMP °C | BAROMETRIC PRESSURE $N/m^2$ | FLOW READING $M^3$ |
|---|---|---|---|---|---|---|---|---|
| 29-30/4/97 | | | | | | | | |
| 29 | -1 | 0.0019778 | 271 | 36 | 50.56 | 18.2 | | 0.1 |
| 29 | 0 | 0.0022712 | 271 | 36 | 44.03 | 18.2 | | 0.1 |
| 29 | 1 | 0.0023641 | 271 | 36 | 42.3 | 18.2 | | 0.1 |
| 29 | 2 | 0.0024486 | 271 | 36 | 40.84 | 18.2 | | 0.1 |
| 29 | 3 | 0.0024888 | 271 | 36 | 40.18 | 18.2 | | 0.1 |
| 29 | 4 | 0.0025439 | 271 | 36 | 39.31 | 18.2 | | 0.1 |
| 29 | 5 | 0.002551 | 271 | 36 | 39.2 | 18.2 | | 0.1 |
| 29 | 6 | 0.0015312 | 271 | 36 | 65.31 | 17.85 | | 0.1 |
| 30 | 7.5 | 0.0015632 | 271 | 36 | 63.97 | 17.85 | | 0.1 |
| 30 | 10 | 0.0016218 | 271 | 36 | 61.66 | 18.1 | | 0.1 |
| 30 | 12.5 | 0.0016545 | 271 | 36 | 60.44 | 18.1 | | 0.1 |
| 30 | 15 | 0.0016912 | 271 | 36 | 59.13 | 18.2 | | 0.1 |
| 30 | 17.5 | 0.0017241 | 271 | 36 | 58 | 18.2 | | 0.1 |
| 30 | 28 | 0.0019157 | 271 | 36 | 52.2 | 18.2 | | 0.1 |

Figure 5C

Notch 4 - nominal opening 20 mm

| DATE | ANGLE OF ATTACK deg ° | FLOW Q ($m^3/s$) | TOTAL HEIGHT (mm) | HEIGHT VAR (mm) | TIME sec | TEMP °C | BAROMETRIC PRESSURE $N/m^2$ | FLOW READING $M^3$ |
|---|---|---|---|---|---|---|---|---|
| 6-12/5/98 | | | | | | | | 0.1 |
| 12 | 0 | 0.0020308 | 271 | 36 | 49.24 | 17.3 | | 0.1 |
| 12 | 1 | 0.0020301 | 271 | 36 | 49.26 | 17.3 | | 0.1 |
| 12 | 2 | 0.0021049 | 271 | 36 | 47.51 | 17.4 | | 0.1 |
| 9 | 3 | 0.0020395 | 271 | 36 | 49.03 | 17.6 | | 0.1 |
| 9 | 4 | 0.0020629 | 271 | 36 | 48.48 | 17.5 | | 0.1 |
| 9 | 5 | 0.0020956 | 271 | 36 | 47.72 | 17.5 | | 0.1 |
| 9 | 7.5 | 0.0021714 | 271 | 36 | 46.05 | 17.45 | | 0.1 |
| 9 | 10 | 0.0022444 | 271 | 36 | 44.56 | 16.7 | | 0.1 |
| 9 | 12.5 | 0.0023076 | 271 | 36 | 43.34 | 16.2 | | 0.1 |
| 6 | 15 | 0.0022378 | 271 | 36 | 44.69 | 17.2 | | 0.1 |
| 6 | 17.5 | 0.0022784 | 271 | 36 | 43.89 | 17.2 | | 0.1 |
| 6 | 20 | 0.0023236 | 271 | 36 | 43.04 | 17.2 | | 0.1 |
| 6 | 23 | 0.0025994 | 271 | 36 | 38.47 | 17.6 | | 0.1 |
| 6 | 28 | 0.0027239 | 271 | 36 | 36.71 | 17.9 | | 0.1 |

Figure 5D

Notch 5 - nominal opening 25 mm

| DATE | ANGLE OF ATTACK deg ° | FLOW Q ($m^3/s$) | TOTAL HEIGHT (mm) | HEIGHT VAR (mm) | TIME sec | TEMP °C | BAROMETRIC PRESSURE $N/m^2$ | FLOW READING $M^3$ |
|---|---|---|---|---|---|---|---|---|
| 9-/5/98 | 0 | 0.002649 | 271 | 36 | 37.75 | 17.8 | | 0.1 |
| 9 | 1 | 0.0026759 | 271 | 36 | 37.37 | 17.8 | | 0.1 |
| 11 | 2 | 0.0027029 | 271 | 36 | 37 | 16.8 | | 0.1 |
| 11 | 3 | 0.0027397 | 271 | 36 | 36.5 | 17.1 | | 0.1 |
| 11 | 4 | 0.0027809 | 271 | 36 | 35.96 | 17.2 | | 0.1 |
| 11 | 5 | 0.0028301 | 271 | 36 | 35.34 | 17.2 | | 0.1 |
| 11 | 7.5 | 0.0029091 | 271 | 36 | 34.38 | 17.25 | | 0.1 |
| 11 | 10 | 0.002992 | 271 | 36 | 33.42 | 17.35 | | 0.1 |
| 11 | 12.5 | 0.0030616 | 271 | 36 | 32.66 | 17.4 | | 0.1 |
| 11 | 15 | 0.0031434 | 271 | 36 | 31.81 | 17.6 | | 0.1 |
| 11 | 17.5 | 0.0032157 | 271 | 36 | 31.1 | 17.7 | | 0.1 |
| 11 | 20 | 0.0032362 | 271 | 36 | 30.9 | 17.7 | | 0.1 |
| 11 | 30 | 0.0032135 | 271 | 36 | 31.12 | 17.9 | | 0.1 |

LIQUID FLOW CONTROLLER DEVICE

BACKGROUND TO THE INVENTION

Various methods are known and have been proposed to control the flow of liquid from a source and the present invention is particularly concerned to provide a method and means for controlling the flow of liquid from a body of the liquid and in particular the flow of water from dams, water storage systems and other bodies of water.

When large volumes of water are stored the rapid discharge of water from the storage medium can create problems, particularly if it is intended to discharge water at or near the level of the head of the water. If water is to be discharged over or through a discharge outlet that is adjacent to the normal level of water within the storage medium, then a significant weight of water must be built up in the storage medium above the level of the outlet before the water will flow freely. This can have a detrimental effect not only on the storage medium, but also on the environment downstream of the discharge point because with known technology it is not possible to adequately regulate the flow of water under low head conditions. It is considered that there are considerable advantages in facilitating the discharge of water over or through an outlet at a rate which is greater than the rate that would normally be generated by the head of water behind the outlet.

When electric power is generated through a hydro electrical system, the energy to rotate the electrical generators is generally obtained by leading water from a dam through a penstock or other usual form of closed or open race to the generator. Generally therefore the generators are situate considerably below the level of the head of the water. Because of the high energy requirements of the electrical power generation systems, very large volumes of water are required which results in the construction of massive dams to store the water. The ecological disadvantages of such dams are significant, not only because of the large tracts of land that must be flooded to provide the head of water, but also in the construction of the dam and the interruption of the flow of water that would have otherwise been available for other purposes.

It is apparent that a system that would enable comparable electrical power to be generated by using less head of water than was previously possible would provide considerable advantages not only to the owner of the electricity generating system but also to the surrounding ecology. That would mean the size of the dam and the volume of the body of the water required to be stored behind the dam can be lessened.

It is well known to harness energy from water to drive pelton wheels and other means of transforming the flow of water into a mechanical rotatory motion. In these situations comparatively small dams are often built and the energy transforming means is situated at or adjacent to the foot of a spillway from the dam. It is considered that if the flow of water from the stored water can be enhanced, particularly by increasing the speed of water flowing down the spillway, then less water will be required to generate the same amount of power. This would have considerable advantages where the volume of water is scarce since it would enable smaller storage systems to be built to obtain the required amount of energy.

OBJECT OF THE INVENTION

It is an object of this invention to provide means for enabling liquid to be discharged from a source of the liquid at or about the level of the head of the liquid in a manner that the liquid will flow from the source of liquid at a rate that is faster than if the means were absent.

DISCLOSURE OF THE INVENTION

Accordingly one form of the invention may be said to comprise a liquid flow control device wherein a controller having a leading edge and an essentially planar undersurface is positioned above the entrance to a spillway which communicates with a source of the liquid to provide a gap between the entry to the spillway and the underside of the controller and wherein an angle of attack is formed between the spillway and the undersurface of the controller which will create an accelerative venturi effect on liquid passing through the gap onto the spillway.

Preferably the controller is located above the entrance to the spillway be means which will enable the controller to pivot to cause the angle of attack to change.

Preferably the controller is located above the spillway be means which will enable the gap between the controller and the spillway to be increased or decreased.

Preferably the source of liquid comprises a dam.

BRIEF DESCRIPTION OF THE DRAWINGS

Preferred forms of the invention will now be described with the aid of the accompanying drawings in which:

FIGS. 5A, 5B, 5C and 5D are tables of data extracted from the preliminary tests.

DETAILED DESCRIPTION OF PREFERRED FORMS OF THE INVENTION

Figure 1:
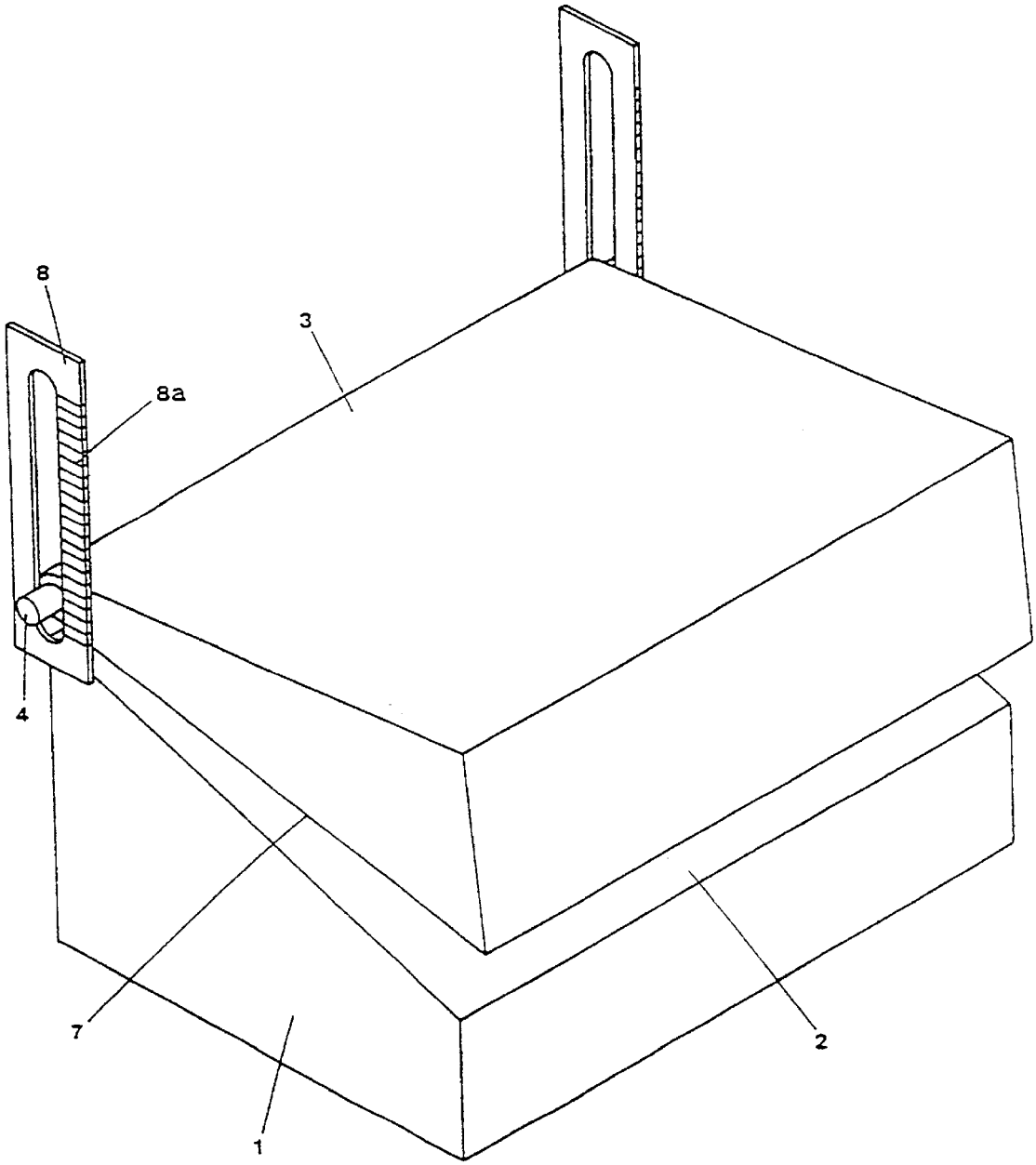
FIG. 1 is a diagrammatic view of a model of one form of the controller used in the production of the test date.

As illustrated in the drawings, the model controller is applied to a model of an end wall 1 of a water storage system with has a fixed spillway 2 subtending an appropriate angle to the level of the water in the storage system. A controller 3, which is the case of the model under consideration is pivoted at 4 above the entry 5 of the spillway 2 is preferably of a wedge shape and has a nose 6 and an essentially planar undersurface 7. The controller is pivoted in a manner that the nose 6 of the controller will be spaced above the entry 5 to the spillway to create a gap between the nose 6 and the entry 5. The gap will remain constant across the full length of the spillway whereby the controller will rotate around a defined arc radius. This will maintain a constant distance between the undersurface 7 of the controller 3 and the spillway 2 to provide a constant angle of attack 11.

Support means such as that indicated at 8 can be employed so the gap between the nose of the controller and the entry 5 can be adjusted within predetermined limits.

Various means can be utilised to effect the adjussment. In the model herein described and illustrated in the drawings, notches 8*a* are formed in the support means to enable the pivot points 4 to be raised or lowered as required.

Figure 2:
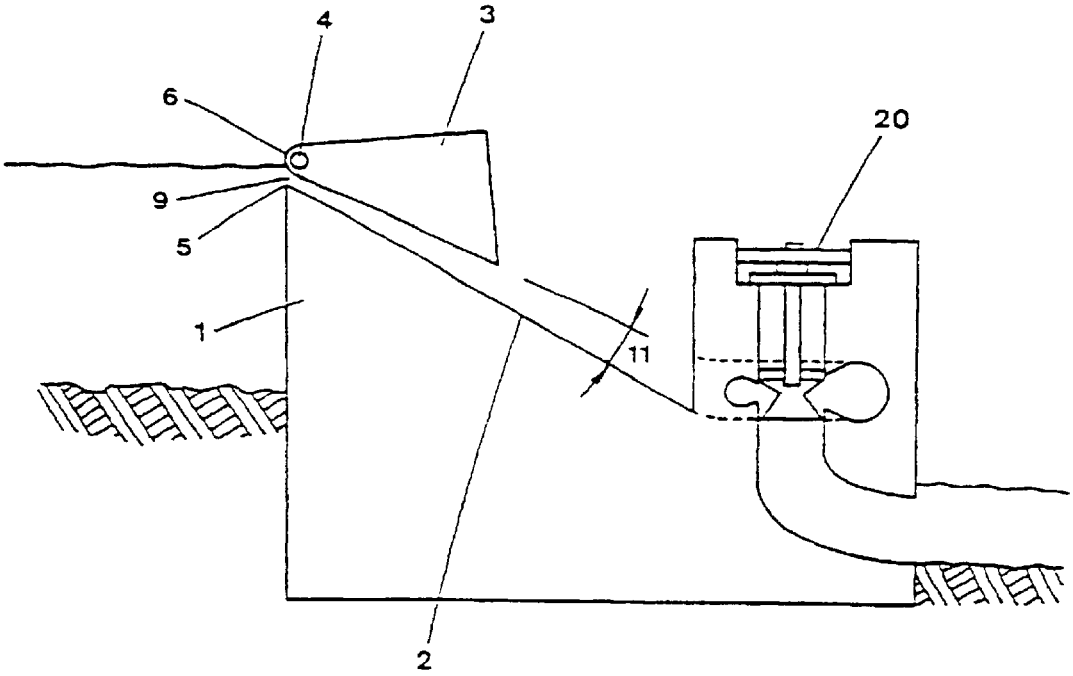
FIG. 2 is a diagrammatic side view of a controller illustrating the usage of the controller in conjunction with a turbine type electrical generator.
Figure 3:
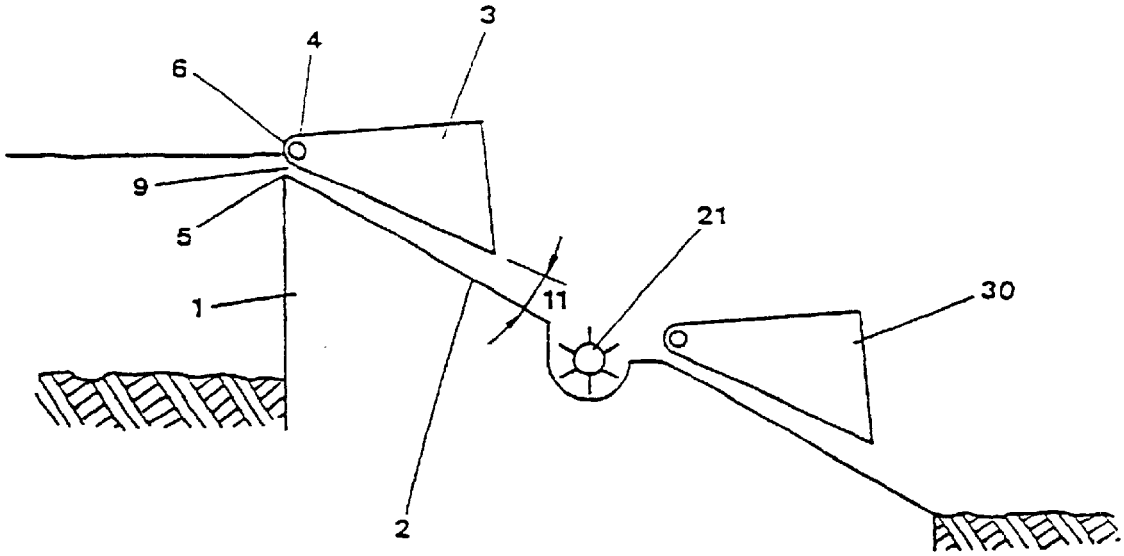
FIG. 3 is a diagrammatic view of a controller illustrating the usage of the controller in conjunction with a paddle wheel type of electrical generator.

As illustrated in FIGS. 1 and 2, the gap forming the entrance 5 to the spillway is formed by the leading edge of the controller 3 and the edge of the spillway 2. The depth of the gap 9 can be varied by raising of lowering the controller on its pivot points 4 while the controller can be pivoted on the pivot pins 4 to enable the angle of attack 11 to be adjusted. Water flowing down the spillway can be utilised to power a turbine type electricity generator as illustrated diagrammatically at 20 in FIG. 2 or a paddle wheel type electricity generator as illustrated diagrammatically at 21 in FIG. 3. As is also illustrated in FIG. 3, an additional controller 30 can be positioned downstream of the generator which is located part way down the spillway 2.

Figure 4:
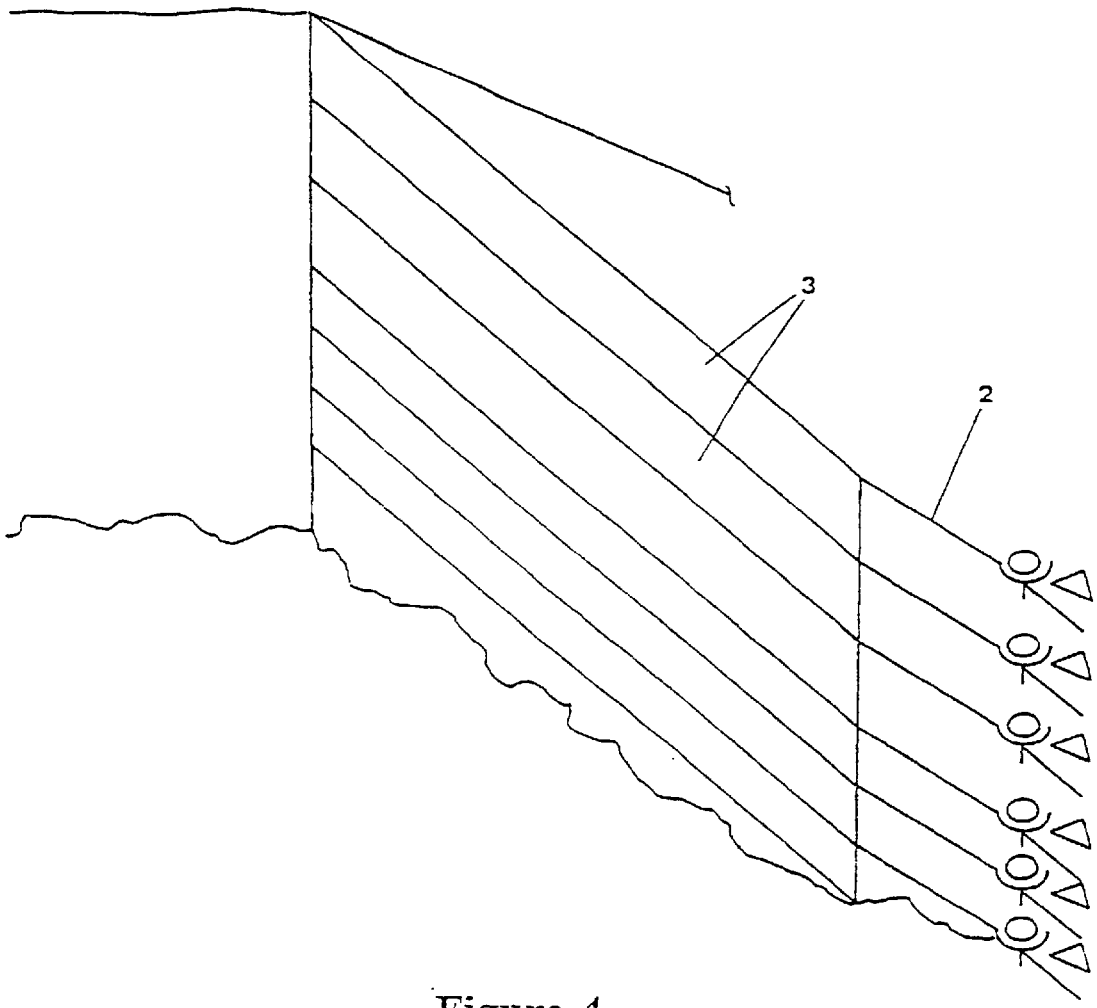
FIG. 4 is a diagrammatic view of a spillway of a dam utilising a plurality of the controllers.

When the angle of attack is within specified limits the rate of liquid flow is accelerated under either low or high head pressures because of negative pressure which is generated by the effect of the controller. This negative pressure will tend to suck liquid into the throat while maintaining a laminar flow pattern ahead of the controller/spillway arrangement FIG. 4 illustrates one method of further enhancing the discharge of water from a water storage system. As indicated in this drawing multiple assemblies of the controller 3 are stacked in vertical arrays. This will enable varying rates of flow to be accommodated under varying heads of pressure without undue disturbance to the underlying substratum. The effect of such an arrangement is that the prior need to create deep water dams is no longer necessary thus minimising the requirement to flood environmentally sensitive land masses.

It is considered the incorporation of single or multiple devices at varying heights and variable lengths along the horizontal aspects of a dam containing water will create a negative pressure at the leading face of the dam and a positive pressure at the output side of the dam which is normally formed by a spillway. This will result in an acceleration of the water flow at low head pressures to thereby enhance overall performance.

Based upon a consideration of Euler's equation and the continuity equation as applied to the principles of flow in "venturi type" devices, it is possible to predict the state of liquid flow at three points, that is at the entry point, the junction of the spillway with the throat and the exit from the device in terms of pressure differentials. However, by use of the controller as herein disclosed it is possible to accelerate liquid flow from zero to maximum rates of flow under low or high head pressures by alteration of the angle of attack 11 (incidence) between the undersurface of the controller and the surface of the spillway.

The following examples relate to models of the controller device which simulate the effects of a full size controller.

EXAMPLE

A 300 mm wide model as illustrated in FIG. 1 was scientifically tested under constant inlet head conditions in an Arnfield tilting flume over a wide range of flows and with varying throat geometry. It is apparent from the results that variations in the angle of attack at constant throat openings changed the volumetric flow rate and a correlation was found to exist between the angle of attack and the flow rate.

A high precision engineer's level was attached to the flume channel and the flume bed was levelled to zero plus or minus 5 minutes of arc. Angular displacement of the tilting section of the flume was achieved by the use of a vernier micrometer and checked by means of an Abney level. The flow rate measurement was made using an in-line flow meter calibrated to plus or minus 0.5 percent of measured flow and checked independently by a V notch weir located in the outlet channel of a water re-circulation system. Water was supplied to the flume via a 7 kW submersible pump to a hearder tank with TWL (top water level) at 16.4 m above datum. Datum was set at the geometric centre of the flume bed. Water depths in the flume were measured using a vernier point gauge with its zero set point at datum (accuracy +/−0.05 mm). Temperatures were determined using a mercury in glass thermometer (range 0 to 20 degrees Celsius) calibrated to +/−0.01 degrees and Telarc certified. Time was measured by means of an independently operated pair of electronic stopwatches.

Figure 8:
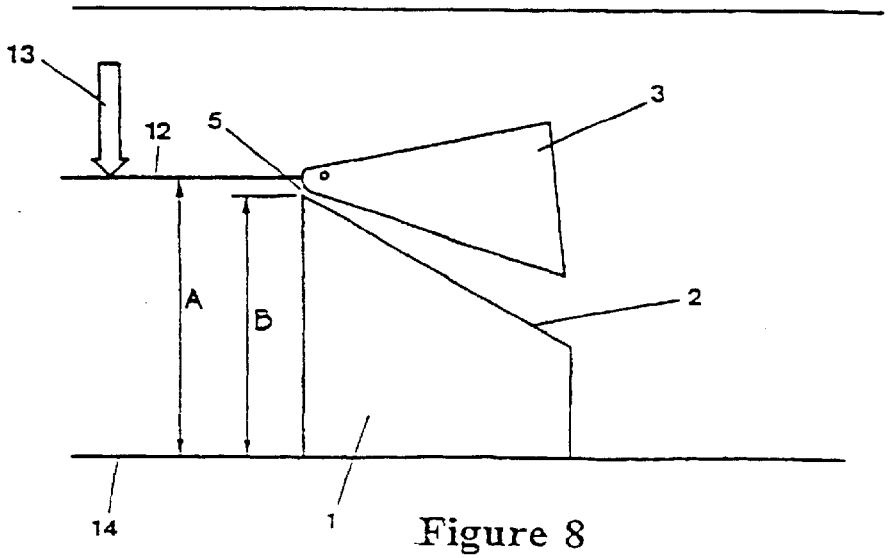
FIG. 8 is a further diagrammatic illustration of the test device.
Figure 6A:
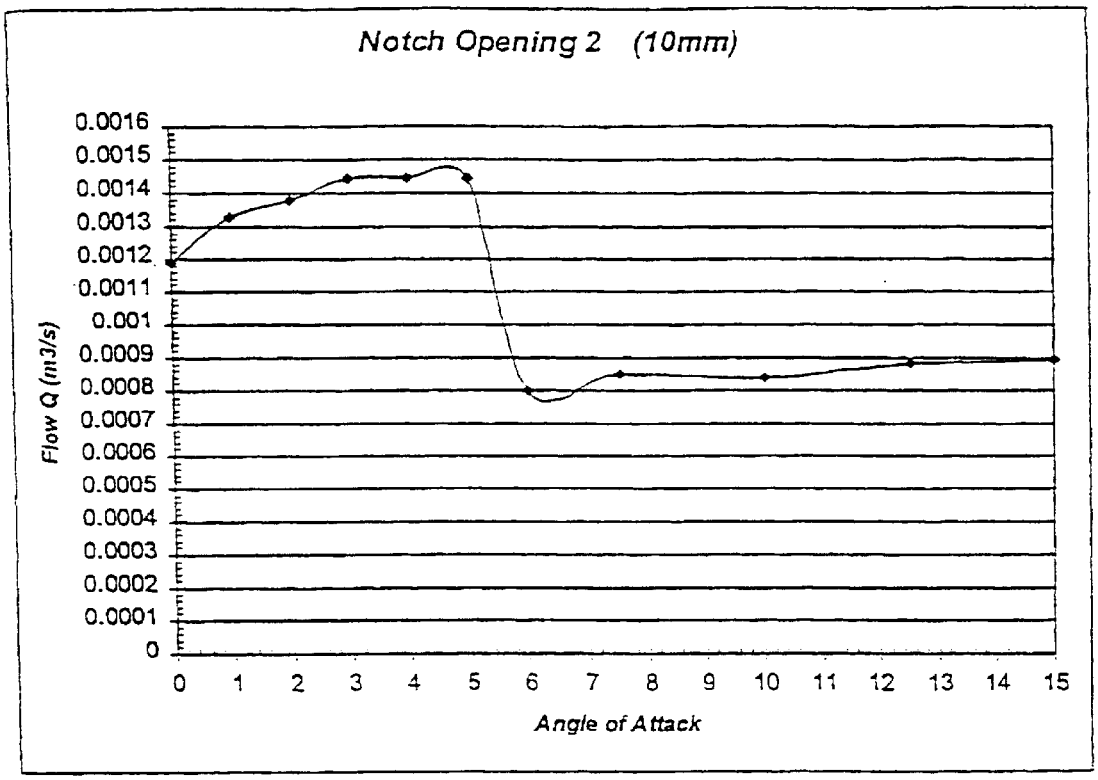
FIGS. 6A, 6B, 6C and 6D are graphs illustrating the performance of the controller under test.
Figure 6B:
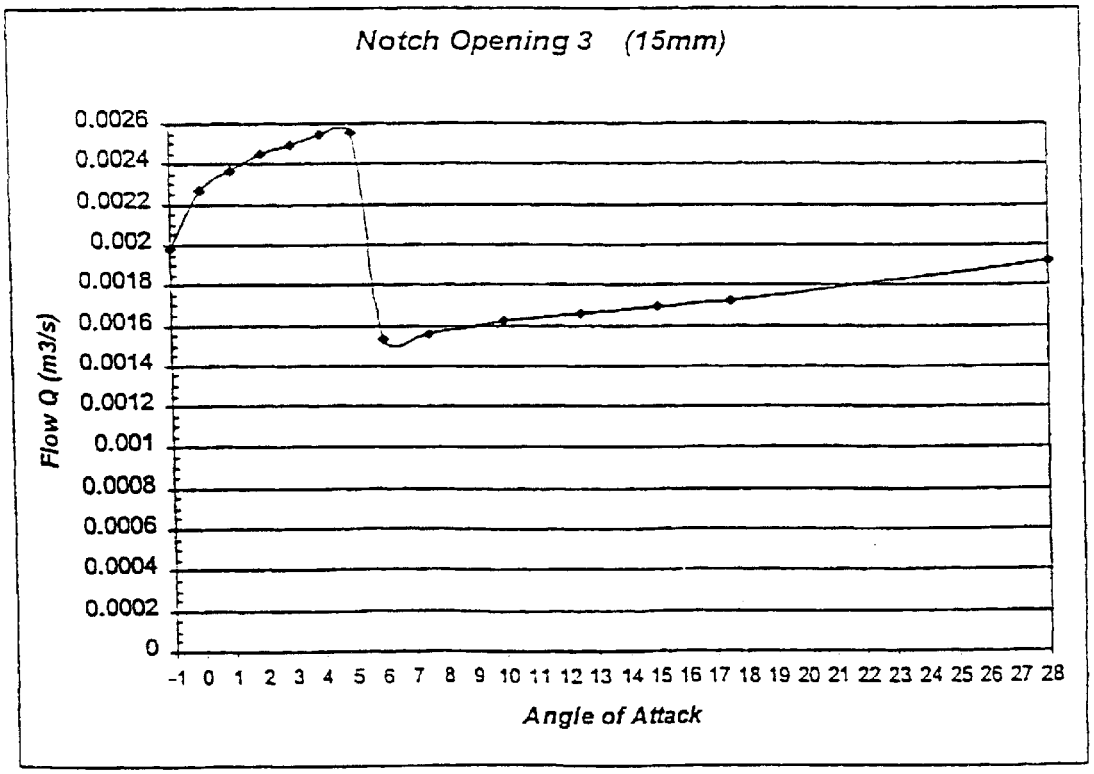
Figure 6C:
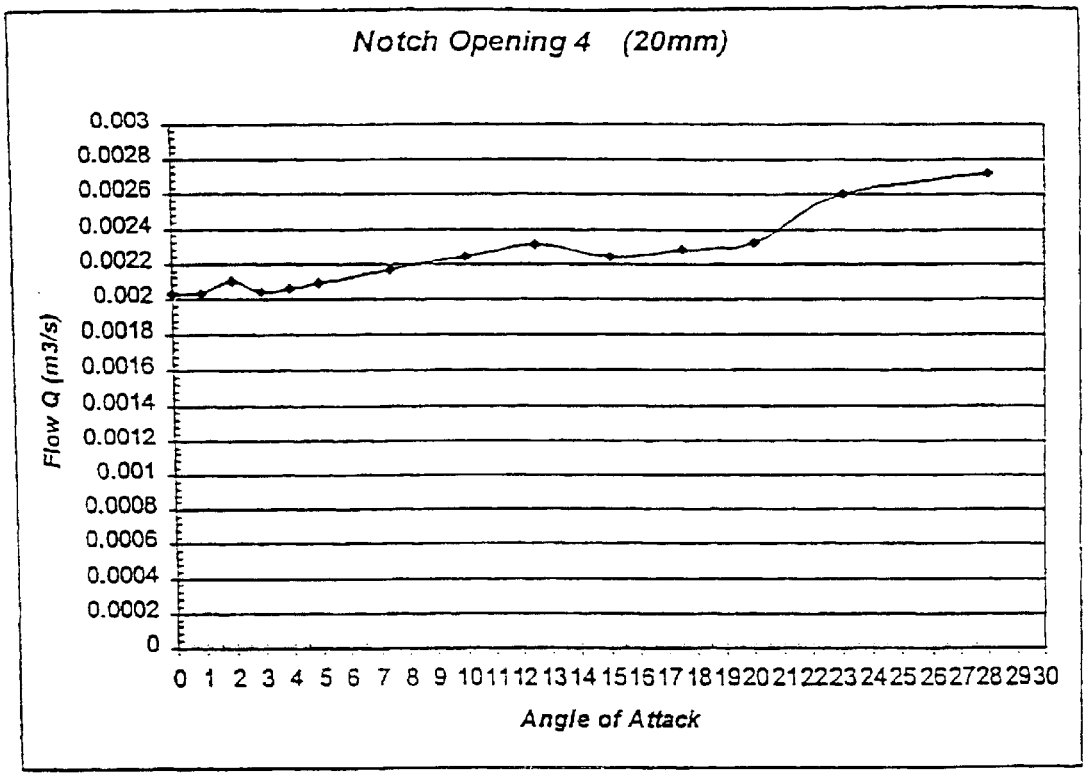
Figure 6D:
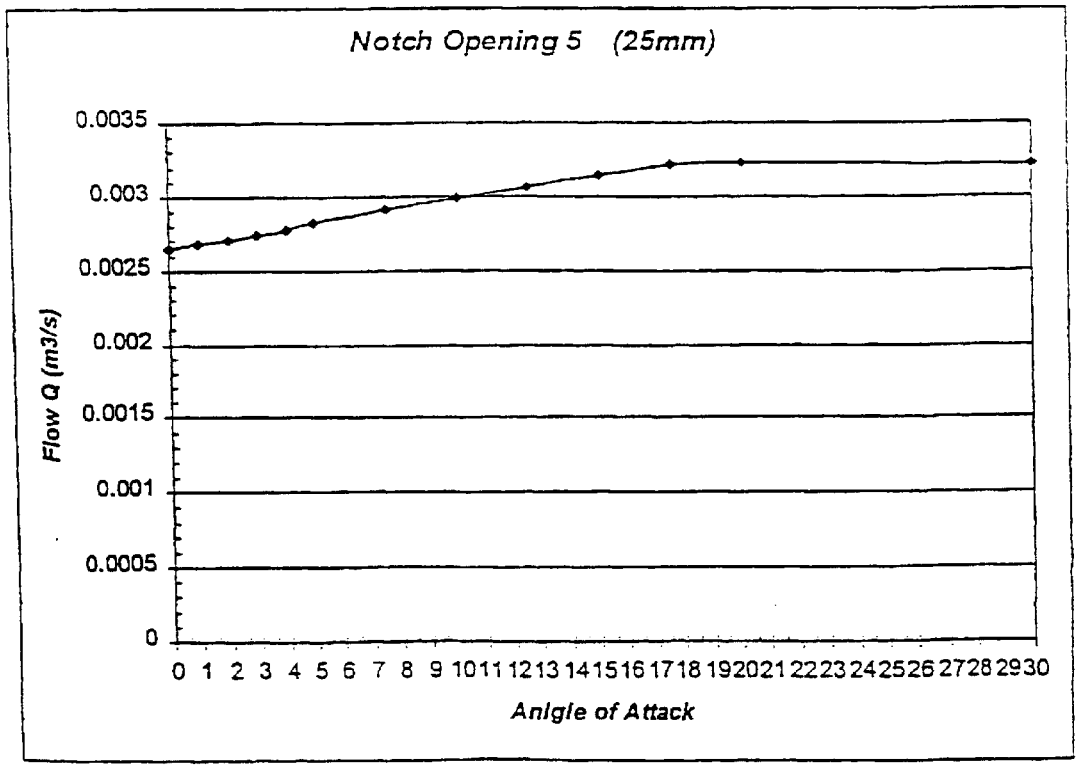

The test device which comprised a controller positioned above a spillway was installed with an upstream face positioned 0.35 m upstream of the centre of a six metre test section of the Armfield flume such that visual observation was not impaired by the support framework. The flume was levelled and the test device checked for alignment using insertion gauges in conjunction with the frame mounted sliding point gauges attached to the top rails of the flume. Point gauges were positioned 1.0 metre upstream of the front face of the test device and locked in position relative to datum. Initial setting of the test device was made, flow was started and adjusted to maintain a stable head of 271 mm above datum 14 as indicated by the arrow A in FIG. 8. The height B of the end wall 1 was 235 mm thereby providing a constant head of 36 mm above the entry 5 to spillway 2. The maintenance of the height of the head of liquid was controlled by a vernier point gauge 13 with its zero set point at datum. Observation of the flow was made after stability was attained, typically a period of two hours was required per reading. The data was recorded manually and the volumetric flow rate calculated from the average of four observations at each configuration.

Figure 7:
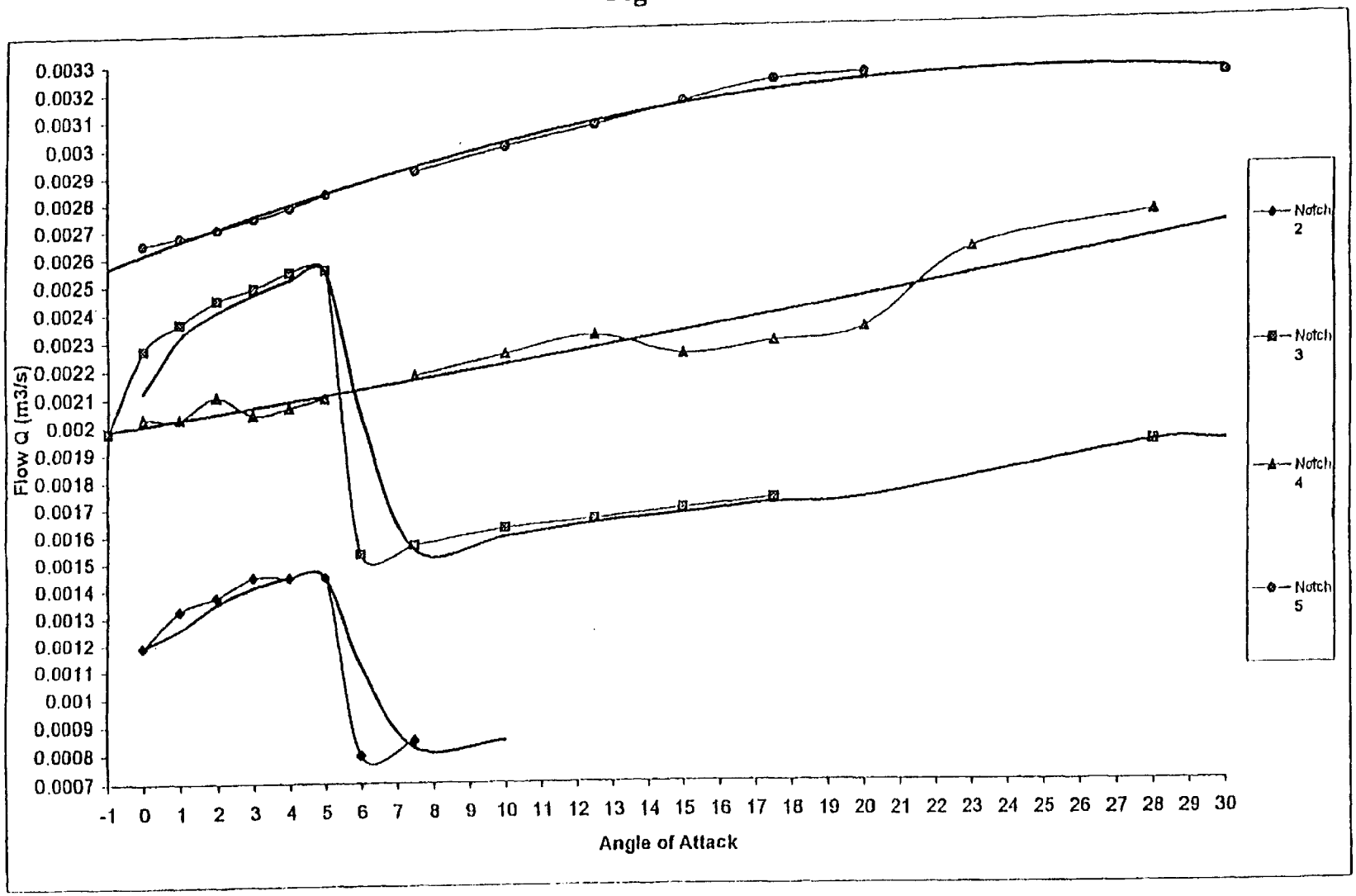
FIG. 7 is a summary graph of a typical test result.

Observations were made for angles of attack from −1 degrees to +28 degrees in varying increments with the gap between the nose 6 and the entry 5 of 10, 15, 20 and 25 mm represented by notches 2 to 5. The data obtained is illustrated in the tables comprising FIGS. 5A, 5B, 5C and 5D. The results of the tests are illustrated in graph form in FIGS. 6A, 6B, 6C and 6D. A comparison of the results is illustrated in FIG. 7.

It was found that a relationship existed between the angle of attack of the spillway and the volumetric flow rate at an applied head of 36 mm above the base of the entry to the spillway. Throat openings are demonstrated to provide increasing flow in the small range of angle of attack. As illustrated in FIG. 7 the volume of liquid when the controller was located in notches 2 and 3 which provided an opening of 10 mm and 15 mm respectively, the flow rate increased as the angle of attack increased. However above a critical angle of attack of about 5° volumetric flow rate rapidly decreased.

It will be apparent that while the present invention is particularly concerned with increasing the volumetric flow rate of water over and down a spillway, the invention can be utilised in many different areas, location and situations where it is desired to increase the efficiency of discharge of water from at or about the level of a head of water.

Having read the foregoing description, it will be apparent to those skilled in the art that modifications and amendments can be made to the specific forms of the controller and the method of adjusting the controller and yet still come within the basic concept of the invention. All such modifications and amendments are intended to be included in the scope of the present invention.

What is claimed is:

1. A liquid flow control device comprising a controller having a leading edge and an essentially planar undersurface is positioned above the entrance to a spillway, said essentially planar undersurface extending across said spillway in communication with a source of the liquid to provide a gap between the entry to the spillway and the underside of the controller and wherein an angle of attack is formed between the spillway and the undersurface of the controller which will create an venturi effect on liquid passing through the gap onto the spillway when contacting said essentially planar undersurface.

2. A device as claimed in claim 1 in which the controller is located above the entrance to the spillway by means which will enable the controller to pivot to cause the angle of attack to change.

3. A device as claimed in claim 2 in which the controller is located above the spillway by means for enabling the gap between the controller and the spillway to be increased or decreased.

4. A device as claimed in claim 1 in which the source of liquid comprises a dam.

5. A device as claimed in claim 2, in which the source of liquid comprises a dam.

6. A device as claimed in claim 3, in which the source of liquid comprises a dam.

* * * * *